US009887055B2

(12) United States Patent
McTigue et al.

(10) Patent No.: US 9,887,055 B2
(45) Date of Patent: Feb. 6, 2018

(54) MECHANICAL FUSE DEVICE

(71) Applicant: Gigavac, LLC, Carpinteria, CA (US)

(72) Inventors: Murray Stephan McTigue, Carpinteria, CA (US); Bernard Victor Bush, Santa Barbara, CA (US); Eric Glenn Hufstedler, Ventura, CA (US); Brent James Swartzentruber, Ventura, CA (US); Michael Henry Molyneux, Santa Barbara, CA (US); Daniel Sullivan, Santa Barbara, CA (US)

(73) Assignee: GIGAVAC, LLC, Carpinteria, CA (US)

( * ) Notice: Subject to any disclaimer, the term of this patent is extended or adjusted under 35 U.S.C. 154(b) by 0 days.

(21) Appl. No.: 15/146,300

(22) Filed: May 4, 2016

(65) Prior Publication Data

US 2016/0343527 A1 Nov. 24, 2016

Related U.S. Application Data

(60) Provisional application No. 62/163,257, filed on May 18, 2015.

(51) Int. Cl.
*H01H 50/54* (2006.01)
*H01H 9/10* (2006.01)
(Continued)

(52) U.S. Cl.
CPC ..... *H01H 50/54* (2013.01); *H01H 9/10* (2013.01); *H01H 50/023* (2013.01);
(Continued)

(58) Field of Classification Search
CPC ..... H01H 2223/002; H01H 2235/01; H01H 50/023; H01H 50/54; H01H 50/56;
(Continued)

(56) References Cited

U.S. PATENT DOCUMENTS 2,729,722 A * 1/1956 Nelsen ..... H01H 51/065 174/153 R
3,796,980 A * 3/1974 Ellsworth ..... H01H 71/122 337/144
5,583,729 A * 12/1996 Hassler ..... H01H 31/127 361/39

FOREIGN PATENT DOCUMENTS

DE 241431 3/1911
DE 202012013004 8/2014
(Continued)

OTHER PUBLICATIONS

PCT Notification of Transmittal of the International Search Report for Reference No. 341-17-010PC; International Application No. PCT/US2016/032199 for Applicant Gigavac, dated Jul. 22, 2016.

*Primary Examiner* — Bernard Rojas
(74) *Attorney, Agent, or Firm* — Koppel, Patrick, Heybl & Philpott

(57) ABSTRACT

Disclosed herein are efficient mechanical fuse devices that are capable of functioning at high current levels. These devices comprise mechanical features configured such that the fuse devices have a non-triggered state, which allows current to flow through the device, and a triggered state, which does not allow current to flow through the device. In some embodiments, the devices are configured such that a certain pre-determined current level flowing through the device will generate a sufficient electromagnetic field to cause the mechanical elements to transition the fuse device into the triggered state and thus interrupt a connected electrical circuit, device or system. In some embodiments, these devices can also comprise hermetically sealed components.

18 Claims, 10 Drawing Sheets

(51) Int. Cl.

| | |
|---|---|
| ***H01H 81/04*** | (2006.01) |
| ***H01H 85/02*** | (2006.01) |
| ***H01H 50/02*** | (2006.01) |
| ***H01H 50/56*** | (2006.01) |
| *H01H 9/04* | (2006.01) |
| *H01H 71/24* | (2006.01) |
| *H01H 71/08* | (2006.01) |

(52) U.S. Cl.
CPC ..... *H01H 50/56* (2013.01); *H01H 81/04* (2013.01); *H01H 85/0241* (2013.01); *H01H 9/04* (2013.01); *H01H 71/2409* (2013.01); *H01H 71/2463* (2013.01); *H01H 2071/088* (2013.01); *H01H 2223/002* (2013.01); *H01H 2235/01* (2013.01)

(58) Field of Classification Search
CPC ..... H01H 2071/088; H01H 71/2409; H01H 71/2463; H01H 81/04; H01H 85/0241; H01H 9/04; H01H 9/10
See application file for complete search history.

(56) References Cited

FOREIGN PATENT DOCUMENTS

| | | |
|---|---|---|
| GB | 1435544 | 5/1976 |
| WO | WO2008095452 A1 | 8/2008 |

* cited by examiner

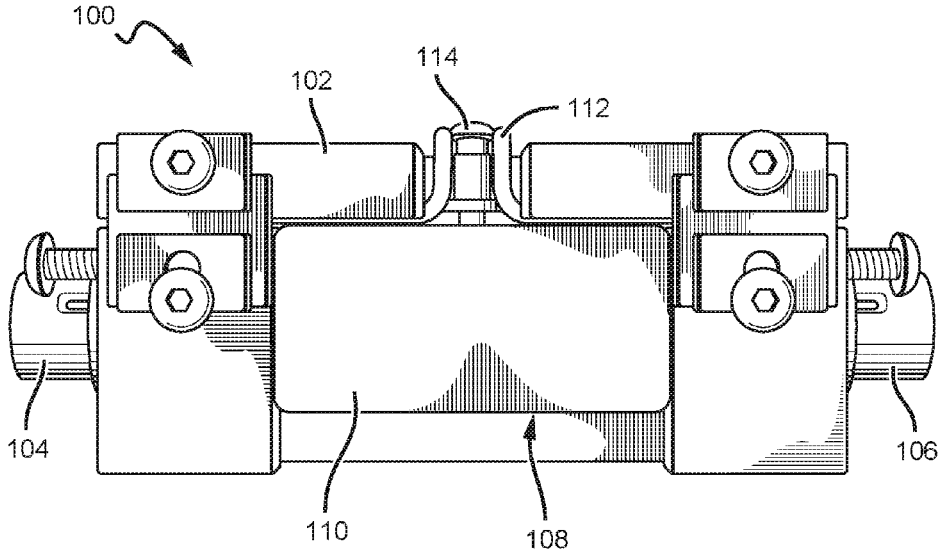
FIG. 1
FIG. 2
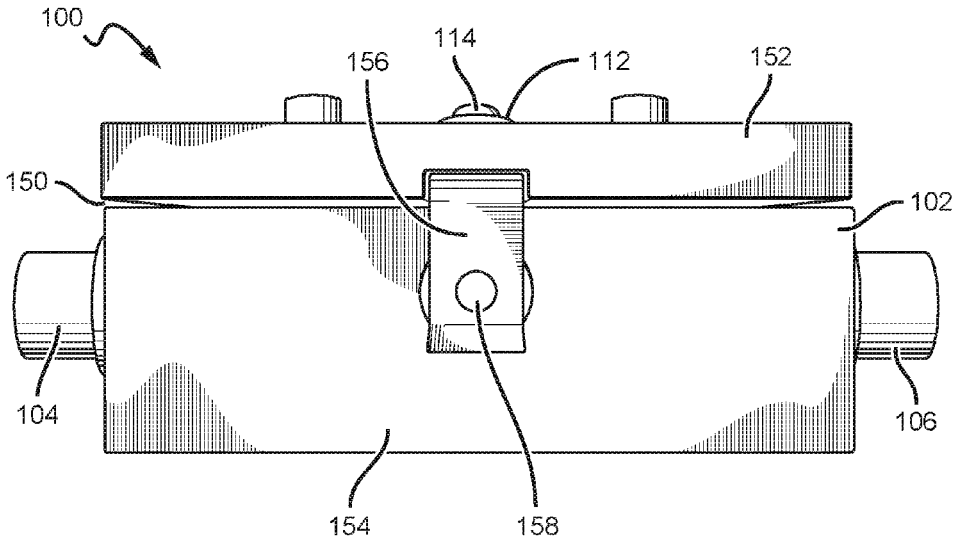

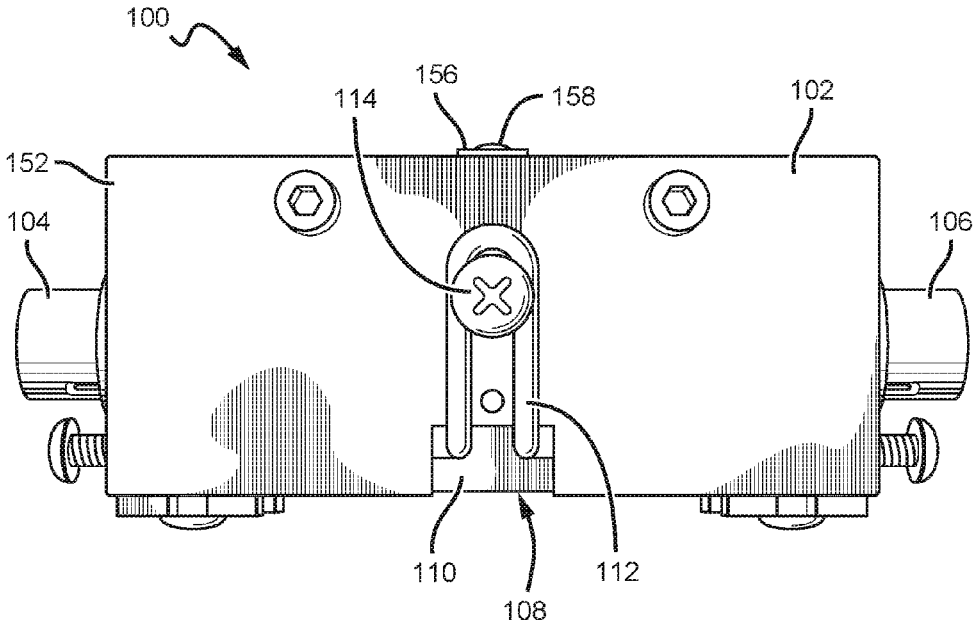
FIG. 3
FIG. 4
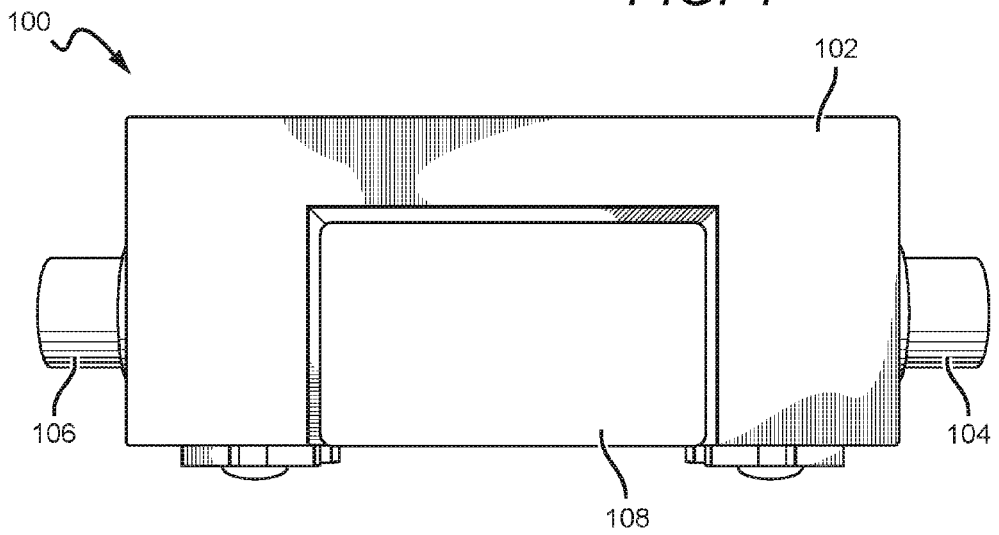

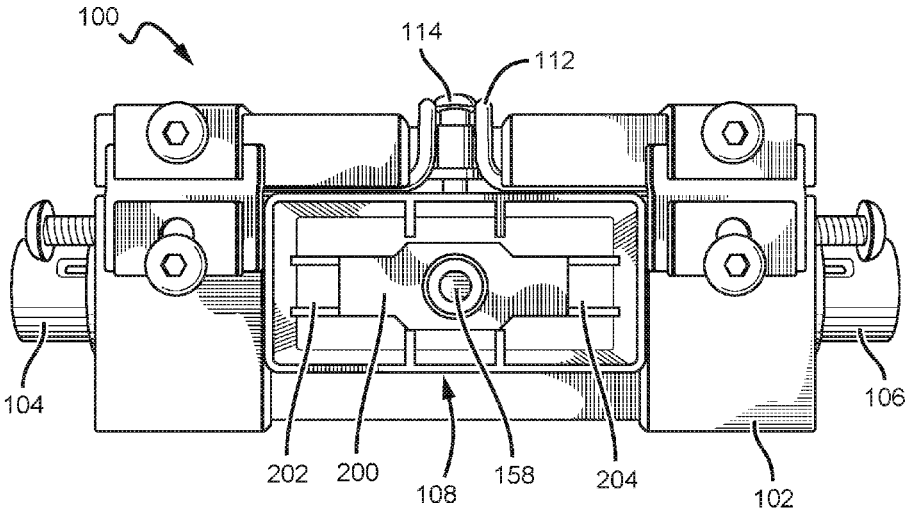
FIG. 5
FIG. 6
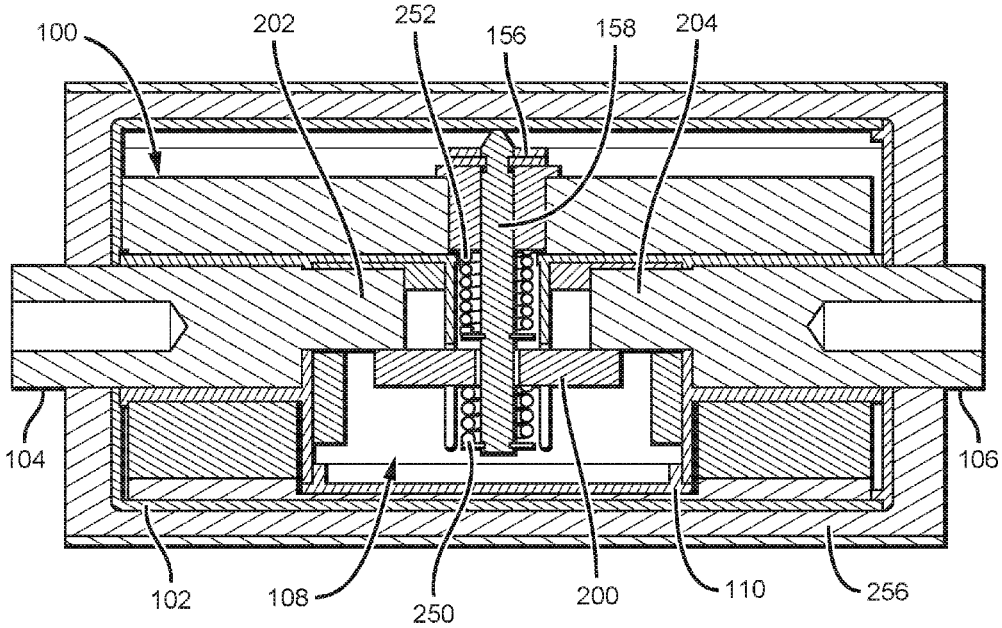

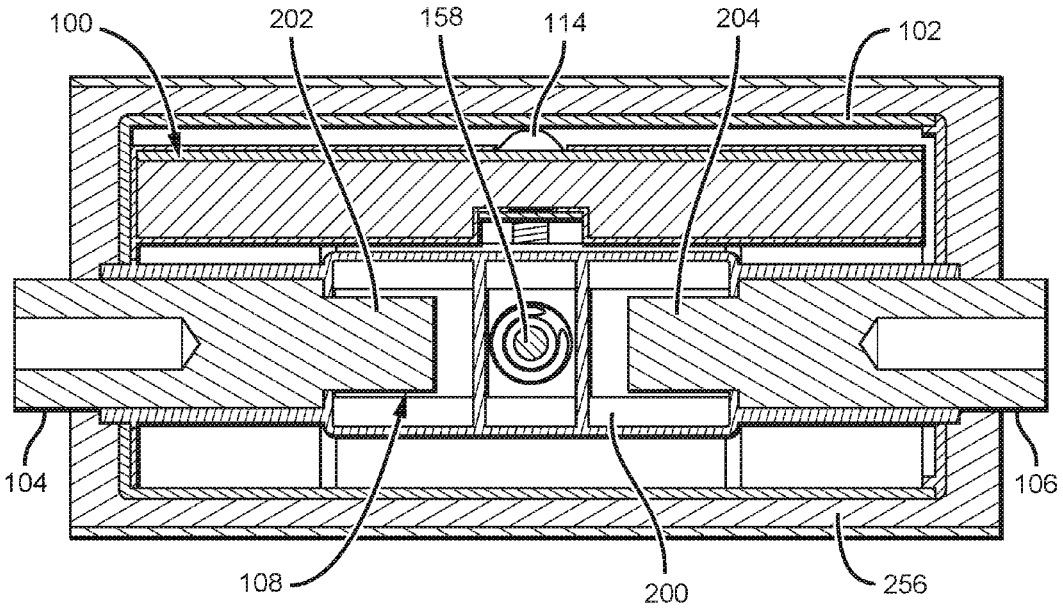
FIG. 7
FIG. 8
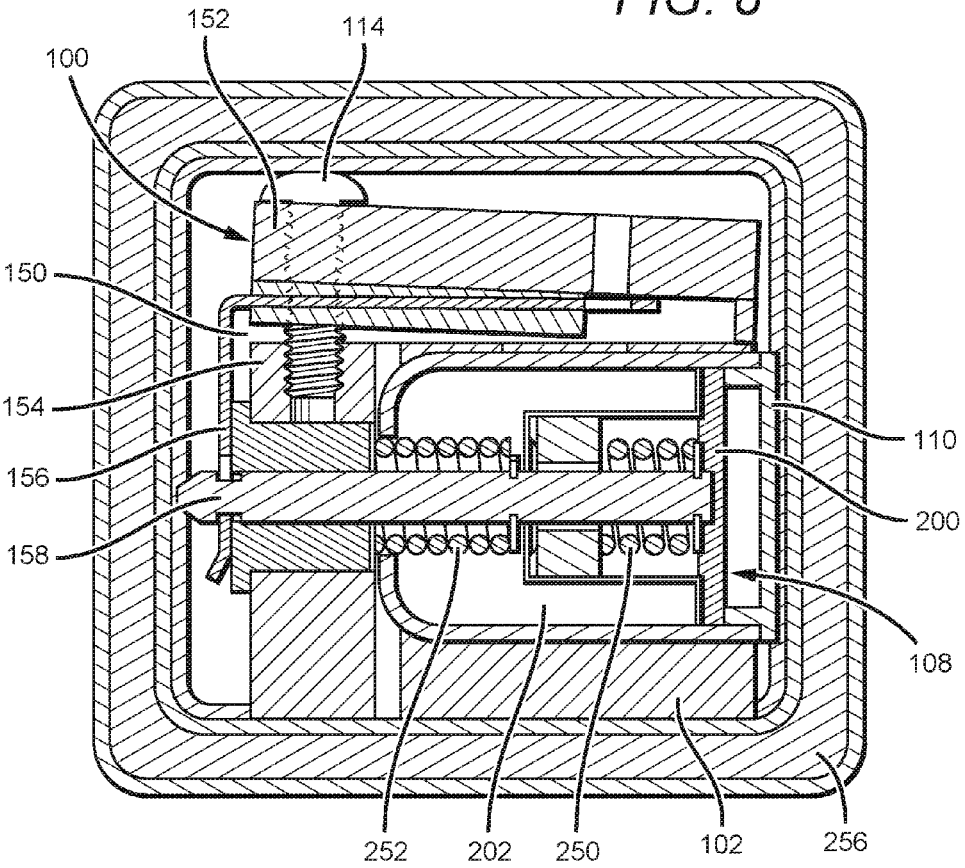

MECHANICAL FUSE DEVICE

CROSS REFERENCE TO RELATED APPLICATIONS

This application claims the benefit of U.S. Provisional Application Ser. No. 62/163,257 to MURRAY S. McTIGUE, et al., entitled MECHANICAL FUSE DEVICE, filed on May 18, 2015, which is hereby incorporated herein in its entirety by reference.

BACKGROUND

Field of the Invention

Described herein are devices relating generally to fuses for use in electrical devices and systems, and specifically to fuses comprising mechanical and/or hermetically sealed features.

Description of the Related Art

In the field of electronics and electrical engineering, various devices can be employed in order to provide overcurrent protection, which can thus prevent short circuits, overloading, and permanent damage to an electrical system or a connected electrical device. Two of these devices include fuses and circuit breakers. A conventional fuse is a type of low resistance resistor that acts as a sacrificial device. Typical fuses comprise a metal wire or strip that melts when too much current flows through it, interrupting the circuit that it connects. Conventional fuses are thus thermal activating solid-state devices.

As society advances, various innovations to electrical systems and electronic devices are becoming increasingly common. An example of such innovations include recent advances in electrical automobiles, which may one day become the energy-efficient standard and replace traditional petroleum-powered vehicles. In such expensive and routinely used electrical devices, overcurrent protection is particularly applicable to prevent device malfunction and permanent damage to the devices. Furthermore, overcurrent protection can prevent safety hazards, such as electrical fires.

Some problems with the utilization of traditional fuses in many modern applications, such as with electrical automobiles, is that many conventional solid-state fuses have difficulty efficiently operating at high currents. Utilizing the electrical automobile example, fuses that will trigger at lower currents will interrupt device function at a much lower current than is actually hazardous, resulting in the automobile becoming unnecessarily powered down. Furthermore, once a conventional fuse is triggered, it is sacrificed and must be completely replaced.

SUMMARY

Described herein are efficient mechanical fuse devices capable of operating at high current. These fuse devices are configured such that they have a first non-triggered or "set" position, which causes the device to allow current to flow through it and maintain a circuit connection, and a second trigged position, which causes the device to not allow current to flow through it. These mechanical fuse devices can operate at higher currents than conventional solid-state fuse devices and in some embodiments, the fuse devices can be "reset" such that the devices can be reusable.

In some embodiments, the fuse devices comprise electromagnetic components. In some embodiments, the fuse devices are configured in a set orientation by one or more mechanical components and are triggered when a desired current level causes an electromagnetic field to generate a force sufficient to overcome the force of the mechanical components. In some embodiments, one or more components of the fuse devices can also be housed within a hermetically sealed housing.

In one embodiment, a fuse device comprises a body comprising at least one body portion and internal components within the fuse device configured to change the state of the fuse device between a set state allowing current flow through the device and a triggered state which interrupts current flow through the device. At least some of the internal components are at least partially surrounded by the body portion. The fuse device also comprises contact structures electrically connected to the internal components for connection to external circuitry. The fuse device is configured such that when a threshold current level passes through the internal components, the body changes configuration in response to a generated electromagnetic field, which causes the device to transition to the triggered state.

In another embodiment, a fuse device, comprises a body comprising at least one body portion and internal components, wherein the internal components comprise: fixed contacts electrically isolated from one another, with the fixed contacts at least partially surrounded by at least one body portion, one or more movable contact, allowing current flow between the fixed contacts when the movable contact is contacting the fixed contacts, an internal pin component connected to the movable contact, the pin being biased toward a position that moves the movable contact out of contact with the fixed contacts, and a pin retention structure configured to hold the internal pin component in place such that the movable contact is contacting the fixed contacts. The fuse device also comprises contact structures electrically connected to the internal components for connection to external circuitry. The fuse device is configured such that when a threshold current level passes through the internal components, the pin retention structure changes configuration in response to a generated electromagnetic field, which causes the internal pin component to move according to its bias.

In yet another embodiment, a fuse device, comprises a body comprising at least one body portion, movable and fixed contacts contacts configured to change the state of said fuse device between a set state allowing current flow through the device and a triggered state which interrupts current flow through the device, one or more secondary contact elements electrically contacting the fixed contacts and contact structures electrically connected to said fixed contacts for connection to external circuitry. The fuse device is configured such that when a threshold current level passes through the contact structures and the movable and fixed contacts, the body changes configuration in response to a generated electromagnetic field, which causes the device to transition to the triggered state. The fuse device is also configured such that the secondary contact element is configured to degrade and no longer contact said fixed contacts when the movable contact is not contacting the fixed contacts and current is flowing through the secondary contact elements.

These and other further features and advantages of the invention would be apparent to those skilled in the art from the following detailed description, taken together with the accompanying drawings, wherein like numerals designate corresponding parts in the figures, in which:

BRIEF DESCRIPTION OF THE DRAWINGS

FIG. 1 is a front view of an embodiment of a fuse device incorporating features of the present invention;

FIG. 2 is a back view of the embodiment of the fuse device of FIG. 1;

FIG. 3 is a top view of the embodiment of the fuse device of FIG. 1;

FIG. 4 is a bottom view of the embodiment of the fuse device of FIG. 1;

FIG. 5 is a front view of the embodiment of the fuse device of FIG. 1, shown with the compartment endcap portion removed;

FIG. 6 is a top sectional view of the embodiment of the fuse device of FIG. 1, shown further housed within a housing structure;

FIG. 7 is a front sectional view of the embodiment of the fuse device of FIG. 6;

FIG. 8 is a left-side sectional view of the embodiment of the fuse device of FIG. 6;

DETAILED DESCRIPTION

Figure 9:
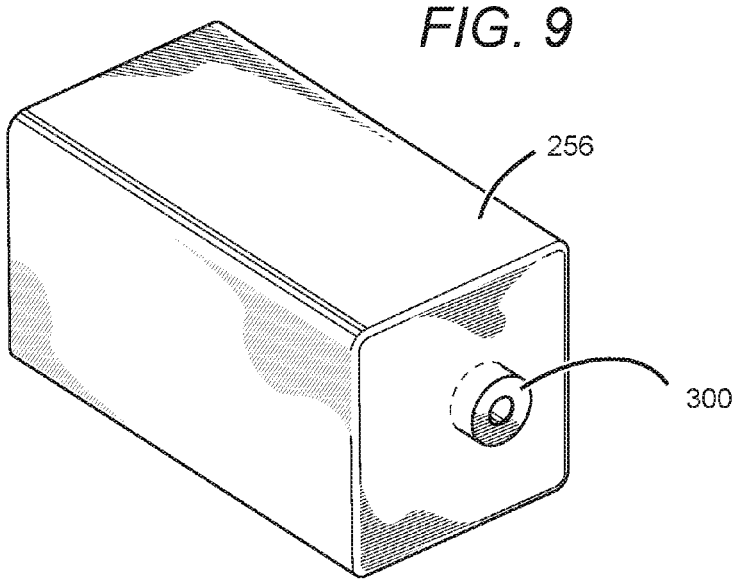
FIG. 9 is a front perspective view of the embodiment of the fuse device of FIG. 6.

The present disclosure will now set forth detailed descriptions of various embodiments. These embodiments set forth fuse devices comprising mechanical components that are configured such that the fuse devices have triggered states (in which a circuit or other electrical flow is interrupted and the fuse is "tripped") and non-triggered states (in which a circuit or other electrical flow is not interrupted and the fuse is "set"). In some embodiments, these mechanical components include a pin structure that is configured with one or more contacts to maintain or interrupt a circuit. In some embodiments, this pin structure is biased toward a triggered position that would break a circuit connected to the fuse device and is maintained against its bias by a mechanical pin retention structure. In some embodiments, one or more of the components of these devices are housed within a hermetically sealed portion. In some embodiments, the devices comprise a metal body at least partially surrounding a conductor.

In some embodiments, the devices are configured such that when a sufficient level of current flows through the device, the body and/or the mechanical pin retention structure will change configuration and cause internal components within the body to interrupt current flow through the device. In some embodiments, this configuration change causes a movable contact to move out of contact with one or more fixed contacts, interrupting current flow. In some embodiments, this configuration change causes release of the pin structure mentioned above, such that the pin moves in accordance to its bias and will break a connected circuit or otherwise interrupt electrical flow.

In some embodiments, this desired breakage current level is translated into force by an electromagnetic field, such that the set mechanical force holding the pin against its bias can be overcome by the force of a corresponding electromagnetic field generated by the required current level. The required values of a fuse for a certain current level, for example, a fuse that will interrupt electrical flow at a current of 3,000 Amps, can be calculated such that the above-described configuration change of the body will be caused by the electromagnetic field generated by the desired current level and therefore will interrupt electrical flow through the fuse device.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "attached," "connected" or "coupled" to another element, it can be directly attached, connected or coupled to the other element or intervening elements may be present. In contrast, when an element is referred to as being "directly attached," "directly connected" or "directly coupled" to another element, there are no intervening elements present.

Relative terms, such as "outer," "above," "lower," "below," "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

It is understood that when a first element is referred to as being "between," "sandwiched," or "sandwiched between," two or more other elements, the first element can be directly between the two or more other elements or intervening elements may also be present between the two or more other elements. For example, if a first element is "between" or "sandwiched between" a second and third element, the first element can be directly between the second and third elements with no intervening elements or the first element can be adjacent to one or more additional elements with the first element and these additional elements all between the second and third elements.

FIGS. 1-5 show external views of an example embodiment of a fuse device 100 and therefore mostly illustrate the external components of the fuse device 100. The internal components are best viewed in FIGS. 6-8. FIG. 1 shows the fuse device 100 comprising a body 102, which comprises at least one body portion, and contact structures 104, 106 (two shown) which are configured to electrically connect the fuse device to external circuitry, for example, an electrical system or device. The body 102 can comprise any suitable material that can support the structure and function of the fuse device as disclosed herein, with a preferred material being a material that can interact with an electromagnetic field generated by current flowing through the device, for example, a metal or metallic material. In some embodiments, the body 102 comprises iron. In some embodiments, the body at least partially surrounds the various internal components.

The contact structures 104, 106 are configured such that the various internal components of the fuse device 100 that are housed within the body 102 or another portion of the fuse device 100 (such as a compartment as discussed in further detail below) can electrically communicate with an external electrical system or device, such that the fuse device 100 can function as an electrical fuse. The contact structures 104, 106 can comprise any suitable conductive material for providing electrical contact to the internal components of the fuse device, for example, various metals and metallic materials or any electrical contact material and/or structure that is known in the art.

Some of the internal components of the fuse device 100 can be housed in a compartment 108 of the fuse device. The compartment 108 can comprise materials similar to those listed herein with regard to the body 102 as well as any suitable material for providing structural support for the fuse device 100 and protection for the internal components. In some embodiments, the compartment 108 comprises a metal or metallic substance. In some embodiments, the compartment 108 comprises a durable plastic or polymer. In the embodiment shown in FIG. 1, the compartment 108 comprises a plastic material and the body 102 is metallic.

The compartment 108 can comprise an endcap 110 that can be removable and replaceable. In the embodiment shown, the endcap 110 is a front endcap. In some embodiments, the endcap 110 is configured to provide mechanical resistance to a spring force of the internal components of the device, as will be discussed in more detail further below. The compartment 108 can be configured such that the internal space of the compartment, which can house some of the various internal components of the device, is hermetically sealed. This hermetically sealed configuration can help mitigate or prevent electrical arcing between adjacent conductive elements, and in some embodiments, helps provide electrical isolation between contacts separated by a space. In some embodiments, the compartment 108 can be under vacuum conditions.

In some embodiments, the compartment 108 can be at least partially filled with an electronegative gas, for example, sulfur hexafluoride or mixture of nitrogen and sulfur hexafluoride. In some embodiments, the compartment 108 comprises a material having low or substantially no permeability to a gas injected into the housing. In some embodiments, the body itself comprising the hermetically sealed compartment 108, with the internal components therein. In some embodiments, the compartment can comprise various gases, liquids or solids configured to increase performance of the device.

As mentioned previously herein, fuse devices incorporating features of the present invention can comprise mechanical features for setting and triggering the fuse device. In the embodiment shown in FIG. 1, the fuse device 100 is shown in its non-triggered or "set" mechanical orientation. The various non-triggered and triggered orientations will become more apparent as the various drawings are explained in greater detail.

The fuse device 100 can be held in the set orientation by various structures, for example, mechanical structures such as a mechanical resistance structure 112. In the embodiment shown, the mechanical resistance structure 112 is a mechanical arm that is configured to hold the device in the set position until the device is triggered. In the embodiment shown, the mechanical arm 112 is connected to a position bolt 114, which is in turn connected to a part of the body 102. In some embodiments, wherein the fuse device 100 is further housed in a housing, for example, a hermetically sealed housing, the housing can function as the mechanical resistance structure. In some embodiments, the mechanical resistance 112 structure is not utilized and the body is configured to be held in a set position by other means.

The fuse device 100 can be configured such that triggering the fuse device 100 by reaching a pre-determined threshold current level will generate an electromagnetic field sufficient to overcome the force provided by the mechanical resistance structure 112 (or the configuration of the body or another mechanical structure holding the device in a non-triggered position) and trigger the device. The body 102, the mechanical resistance structure 112 and/or the various other components of the fuse device 100 can be configured such that when the current through the device reaches a certain pre-determined current level, for example, 2,000 amps, it will generate a sufficient magnetic field to cause the fuse device 100 to overcome the force of the mechanical resistance structure 112 and trigger the device.

Some various structures that can maintain the fuse device 100 in its set position are better shown in FIG. 2. FIG. 2 shows the fuse device 100, the body 102, the contact structures 104, 106, mechanical resistance structure 112 and the position bolt 114. FIG. 2 shows that in its set orientation, the fuse device 100 also comprises a mechanical position gap 150, that at least partially separates a first body portion 152 from a second body portion 154. The mechanical position gap 150 can be maintained by force applied by the mechanical resistance structure 112, either alone or in conjunction with one or more structures. In some embodiments, a pin retention structure 156 can be utilized to further hold an internal pin component 158 in place, while the device is in its set position. As will be discussed in more detail further below, the pin 158 can be configured with an internal spring structure such that it is under a spring force which biases the pin 158 toward a position where the pin 158 can interact with other internal components and break the circuit. The pin retention structure 156 can be any component, either alone or in conjunction with the mechanical resistance structure 112 that is configured to resist the spring force and hold the pin 158 in place so that the fuse device 100 is in its set position.

It is understood that while the present disclosure specifically recites electromagnetic embodiments configured to overcome pre-set mechanical forces, other configurations generating a force corresponding to a pre-determined current, such that the force can overcome a pre-determined mechanical force is within the scope of the present disclosure.

Once a sufficient electromagnetic force is generated due to the pre-determined current value being reached, the fuse device transitions from its set position, wherein the fuse device allows electrical flow through it, to the triggered position, wherein the electrical device breaks the connected circuit. In the embodiment shown, this transition between positions occurs when the generated electromagnetic field causes the first body portion 152 to become drawn toward the second body portion 154, for example, to a degree that overcomes the force applied by the mechanical resistance structure 112 and/or the pin retention structure 156. This at least partially reduces (and can totally eliminate) the mechanical position gap 150 and therefore mechanically alters or otherwise changes the configuration of the pin retention structure 156. This causes the pin 158 to no longer be restrained, which causes the pin 158 to change orientation within the fuse device 100 and break the circuit.

To help further conceptualize the external components of the fuse device 100, FIGS. 3-4 show a top and bottom view of the fuse device 100 respectively. FIG. 3 shows the fuse device 100, the body 102, the contact structures 104, 106, the compartment 108, the mechanical resistance structure 112, the position bolt 114, the pin retention structure 156 and the pin 158. FIG. 3 shows an example orientation of a way in which the mechanical resistance structure can be connected to the position bolt 114, for example, wrapped around it, such that the first body portion 152 is separated by the second body portion such that mechanical position gap is created.

FIG. 4 shows a bottom view of the fuse device 100, including the body 102, the contact structures 104, 106 and the compartment 108. As shown in FIG. 4, the bottom portion of the compartment 108 can be solid to further protect the components internal to the compartment 108.

Transitioning now into further discussion of the internal components, FIG. 5 shows a front view of the fuse device 100, however this time with the endcap removed such that some of the internal components are exposed. As in FIG. 1, FIG. 5 shows the fuse device 100, the body 102, the contact structures 104, 106, the compartment 108, the mechanical resistance structure 112 and the position bolt 114. FIG. 5 further shows an internal portion of the pin 158, one or more movable contacts 200 (one shown) and one or more fixed contacts 202, 204 (two shown).

The fixed contacts 202, 204 can comprise similar materials to the contact structures 104, 106 and can be configured such that they are in contact with their respective contact structures 104, 106, such that an electrical signal running through the first contact structure 104 will be conducted through the first fixed contact 202 and an electrical signal running through the second contact structure 106 will be conducted through the second fixed contact 204. The first and second fixed contacts 202, 204 can be configured such that there is electrical isolation between them, for example, the contacts 202, 204 can be separated by an electrically insulating material or simply by an electrically isolating spatial gap. In some embodiments, wherein the housing 108 is hermetically sealed, under vacuum conditions and/or filled with an electronegative gas, potential electrical arcing between the fixed contacts 202, 204 can be further reduced or prevented, resulting in further electrical isolation. In some embodiments, the fixed contacts 202, 204 are separate structures in electrical contact with their respective contact structures 104, 106. In other embodiments, the fixed contacts 202, 204 are integrated with or part of the contact structures 104, 106.

When the fuse device 100 is in its set position, the movable contact 200 can be connected to both of the electrically isolated fixed contacts 202, 204, such that the movable contact 200 functions as a bridge allowing an electrical signal to flow through the device, for example, from the first contact structure 104, to the first fixed contact 202, to the movable contact 200, to the second fixed contact 204, to the second contact structure 106 and vice versa. Therefore, the fuse device 100 can be connected to an electrical circuit, system or device and complete a circuit while in its set position and when the movable contact is in electrical contact with the fixed contacts.

As shown in FIG. 5, the pin 158 can be configured with the movable contact 200, such that a change in orientation of the pin 158 can cause the movable contact 200 to no longer be in contact with the fixed contacts 202, 204. This would therefore break a connected circuit due to the electrical isolation between the fixed contacts 202, 204 without the movable contact 202 to bridge the isolation gap.

The internal components of the fuse device 100 are further shown in the sectional views of FIGS. 6-8. FIG. 6 shows a top sectional view of the fuse device 100. FIG. 6 shows the body 102, the contact structures 104, 106, the compartment 108, the compartment endcap 110, the pin retention structure 156, the pin 158, the movable contact 200 and the fixed contacts 202, 204. FIG. 6 further shows the fuse device 100 housed within a housing 256, which can provide protection, structural support, and/or a hermetically sealed environment for the fuse device 100. FIG. 6 further shows one or more springs 250, 252 (two shown) which are configured to bias the pin 158 toward the compartment endcap 110. Since the movable contact 200 is connected to the pin 158, if the pin 158 were to move according to the bias provided to it by the springs 250, 252, the movable contact 200 would also move and lose contact with the fixed contacts 202, 204, causing the electrical connection to be broken.

In the embodiment shown, the primary component holding the pin 158 in place against its bias is the pin retention structure 156. When sufficient electromagnetic force is generated, for example, sufficient force to cause the first and second portions of the body to come together as set forth above, the pin retention structure 156 can be broken or displaced, releasing the pin 158 and allowing it to move in accordance with the bias provided by the springs 250, 252. This typically results in the pin 158 causing the endcap 110 to be ejected and potentially the pin 158 leaving the compartment entirely. This likewise causes the movable contact 200 to no longer be in electrical communication with the fixed contacts 202, 204, thus breaking the electrical connection.

A front sectional view of the fuse device 100 is shown in FIG. 7. FIG. 7 shows the body 102, the contact structures 104, 106, the compartment 108, the position bolt 114, the pin 158, the movable contact 200, the fixed contacts 202, 204 and the housing 256. This front sectional view further shows the position of the pin 158 in relation to the movable contacts 200.

The sectional view of FIG. 8 shows the interaction of the various internal and external components in transitioning the fuse device 100 from a set position to a triggered position. FIG. 8 shows the body 102 (comprising the first body portion 152 and the second body portion 154), the compartment 108, the compartment endcap 110, the position bolt 114, the mechanical position gap 150, the pin retention structure 156, the pin 158, the movable contact 200, the first fixed contact 202 the springs 250, 252 and the housing 256.

FIG. 8 shows the pin 158 held in position by the pin retention structure 154. The pin 158 is positioned such that the springs 250, 252 are compressed and the spring force biases the pin 158 toward the compartment endcap 110. The movable contact 200 is configured with the pin 158 such that should the pin 158 move according to its bias, the movable contact will move with the pin and break contact with the fixed contacts. This configuration is one example set position of the fuse device 100.

When a sufficient electric current runs through the device 100, an electromagnetic field sufficient to overcome preset mechanical forces keeping the first body portion 152 separated from the second body portion 154 is generated. This in turn disrupts the position of the pin retention structure 154 and allows the pin 158 to move in accordance with its bias and cause the movable contact 200 to break contact with the fixed contacts. As mentioned previously, this will typically result in the compartment endcap 110 being ejected from the compartment 108. The surrounding housing 256 can also serve the purpose of controlling the extent to which the endcap 110 ejects. This prevents an ejected endcap from potentially interfering with a device or electrical system connected to the fuse device 100.

In some embodiments, the fuse device 100 can be resettable and thus can be used more than once, unlike conventional fuses. After the pin 158 and/or the endcap 110 has been ejected, these structures can be replaced and repositioned into the set position. Alternatively, a replacement pin 158 and endcap 110 can be integrated with the fuse device 100. This allows for the fuse device 100 to be utilized multiple times, without the need to be completely replaced.

An external perspective view of the fuse device sealed within the housing 256 is shown in FIG. 9 (the fuse device being internal to the housing and thus not shown). FIG. 9 further shows that the housing 256 can comprise one or more housing contact structures 300 (one shown, however, the embodiment shown comprises a second housing contact structure on the other side not visible according to the viewing angle of FIG. 9). The contact structures 300 can be configured to allow for electrical contact of the corresponding contact structures of the fuse device, without compromising the hermetic seal on the housing 256. In other embodiments, the contact structures of the fuse device itself can protrude from the housing, while still maintaining a hermetic seal.

The housing and/or the compartment 108 can be hermetically sealed utilizing any known means of generating hermetically sealed electrical devices. Some examples of hermetically sealed devices include those set forth in U.S. Pat. Nos. 7,321,281, 7,944,333, 8,446,240 and 9,013,254, all of which are assigned to Gigavac, Inc., the assignee of the present application, and all of which are hereby incorporated in their entirety by reference.

In some alternate embodiments, the mechanical resistance structure can be configured with the compartment, such that movement of the mechanical resistance structure causes movement of the compartment (or the endcap) which can trigger a corresponding change to the internal components and break the circuit. For example, the mechanical resistance structure can be configured such that a sufficient force will cause the position bolt to pull the mechanical resistance structure in a direction that causes the endcap to be removed. In this embodiment, the endcap can be configured such that it is primarily holding back the spring force biasing the pin toward a triggered state, rather than the pin retention structure performing this function. When the endcap is removed, the pin will move toward its bias and break the circuit.

Figure 10:
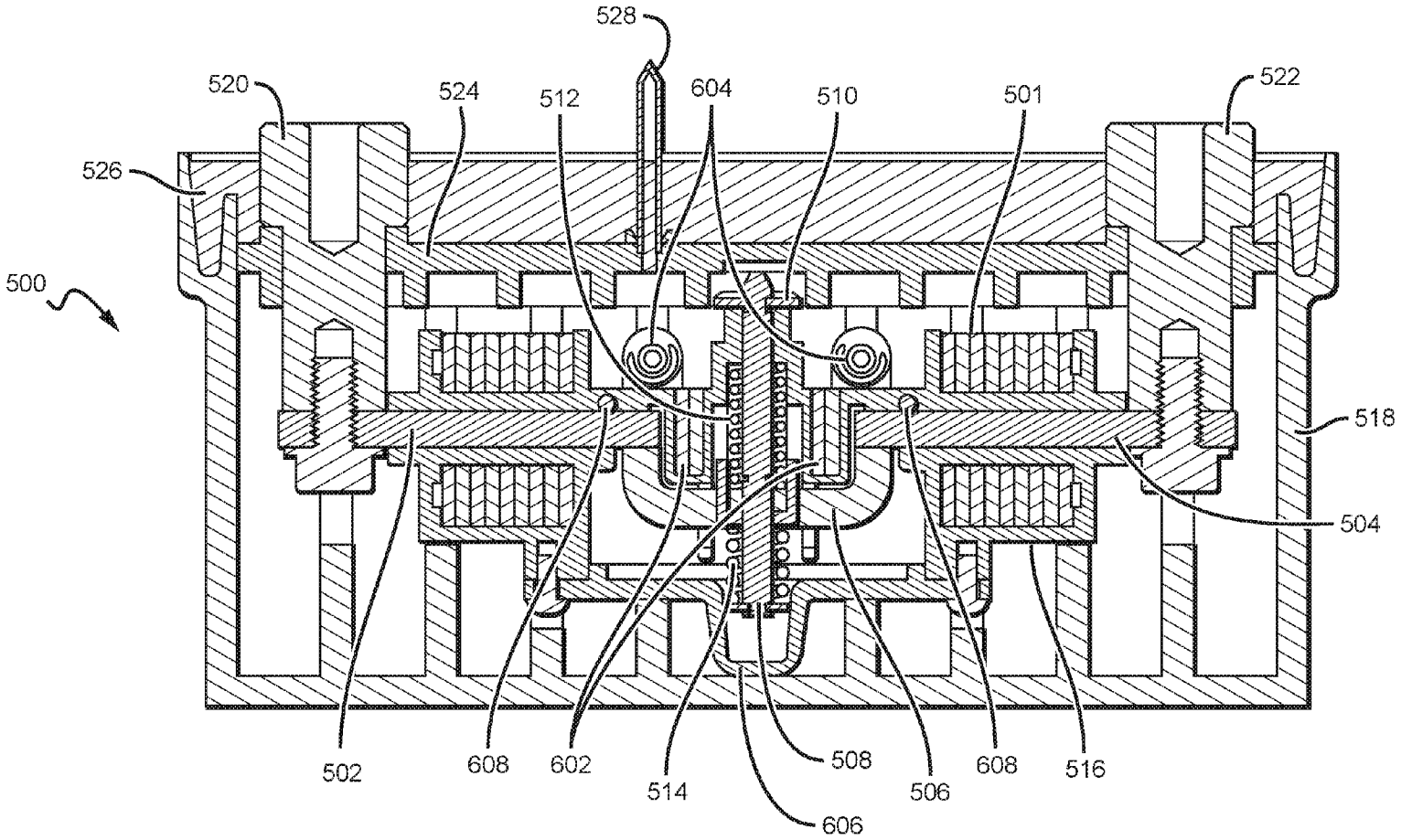
FIG. 10 is a top sectional view of another embodiment of a fuse device incorporating features of the present invention, shown in a non-triggered position and shown further housed within a housing structure.

Even further designs and further features can be utilized with fuse devices incorporating features of the present invention. FIG. 10 shows a fuse device 500 in a set position (allowing electrical flow), which can comprise features similar to the fuse device 100 shown in FIG. 1 above with some features configured differently. For example, FIG. 10 shows that the fuse device 500 can comprise one or more first body portions 501 (two shown), which can at least partially surround the fixed contacts, one or more fixed contacts 502, 504 (similar to the fixed contacts 204, 206 above), one or more movable contacts 506 (one shown; similar to the movable contact 200 above), a pin 508 (similar to the pin 158 above), a pin retention structure 510 (similar to the pin retention structure 156 above), one or more springs 512, 514 (similar to the springs 250, 252 above), a compartment 516 (similar to the compartment 108 above), a housing 518 (similar to the housing 256 above), and one or more housing contact structures 520, 522 (similar to the housing contact structures 300 above).

As with the embodiment of FIG. 1 above, the housing 518 and/or the compartment 516 in FIG. 10 can be hermetically sealed and can comprise features to facilitate hermetic sealing of the housing. In some embodiments, the housing comprises a lid portion 524, which can be sealed to the housing 518 through a sealing material 526, such as an epoxy, therefore forming an airtight seal. A tube 528 can be included in the fuse device to allow for the creation of vacuum conditions and/or for the introduction of one or more electronegative gases as described herein. The fuse device 500 can also be hermetically sealed utilizing any known means of generating hermetically sealed electrical devices. As previously mentioned herein, some examples of hermetically sealed devices include those set forth in U.S. Pat. Nos. 7,321,281, 7,944,333, 8,446,240 and 9,013,254, all of which are assigned to Gigavac, Inc., the assignee of the present application, and all of which are hereby incorporated in their entirety by reference.

Some differences between the embodiment shown in FIG. 10 and the embodiment of FIG. 1 include that instead of a larger body portion surrounding most of the device components, the first body portions 501 (two shown) are magnetic circuits surrounding only a portion of the fixed contacts 502, 504. The first body portions 501 are configured to interact with one or more second body portions (two in this embodiment) which are shown in FIGS. 12-15 and which will be discussed in further detail below. Like with the embodiment in FIG. 1 above, when the flow of current through the device 500 reaches a desired level, a magnetic field will be generated causing the first body portion 501 to become drawn to a second body portion, causing a change in configuration of the body and a resulting change in configuration of the pin retention structure 510, resulting in movement of the pin 508 and therefore the movable contact 506 away from the fixed contacts 502, 504.

Some more additional features included in the fuse device 500 include one or more arc magnets 602, one or more armature springs 604, a pin striking plate 606, and one or more secondary contact elements 608. It is understood that these additional features set forth in FIG. 10 can be incorporated into any of embodiments incorporating features of the present invention, including the embodiment of FIG. 1. The arc magnets 602 are configured to further control the flow of electricity through the device to prevent and/or to mitigate electrical arcing and/or to change or otherwise control the resulting magnetic field caused by electricity flowing through the one or more fixed contacts 502, 504 and the movable contact 506. This can allow for fine-tuning of the force generated by the magnetic field and can assist with more efficient triggering and setting of the fuse device 500.

The armature springs 604 can be configured to maintain a space between different portions of the housing 518, for example, maintaining a mechanical position gap as described in the embodiment of FIG. 1 above. In some embodiments, the armature springs 604 can provide a bias that can partially resist the pull of a generated magnetic field, for example, functioning as a mechanical resistance structure for the electromagnetic field to overcome as discussed above. The pin striking plate 606, functions to prevent the pin 508 from over-travelling or exiting the fuse device 500 when the fuse device 500 is triggered. This can make resetting of the fuse device 500 easier as the pin 508 is not rapidly ejected over a significant distance when the device is triggered.

Another significant additional feature set forth in the embodiment of FIG. 10 is the one or more secondary contact elements 608. While various positioning configurations of the secondary contact element are possible, in the embodiment shown in FIG. 10, there is a single secondary contact element 608, which loops around the top portion of the fuse device 500 and makes contact with the first and second fixed contacts 502, 504 (this is shown more clearly in FIGS. 14-15). The secondary contact element 208 can comprise various structures that can bridge electrical isolation between the first and second fixed contacts 502, 504 to allow at least some electricity to flow through the device. While the embodiments described herein set forth secondary contact elements contacting the fixed contacts, it is understood that in some embodiments incorporating features of the present invention, the secondary contact elements can contact the movable contacts.

In some embodiments, the secondary contact element 608 is configured to degrade or "burn away" in response to a predetermined current threshold or as a result of bearing the current between the fixed contacts when the movable contact is no longer in contact with the fixed contacts. As the secondary contact element 608 is completing the circuit for electrical flow from the first fixed contact 502 to the second fixed contact 504, when the secondary contact element 608 degrades such that it is no longer contacting the fixed contacts 502, 504, the flow of electricity through the fuse device 500 is interrupted. The secondary contact element 608 can comprise any suitable high-resistance conductor, for example copper, nichrome, of alloys of nickel, chromium, iron, copper, and/or other elements. In some embodiments, the secondary contact element 608 can comprise a wire-structure. In some embodiments, the secondary contact comprises nichrome wire.

When used in conjunction with the movable contact 506, the secondary contact element 608 serves to prevent or mitigate electrical arcing in smaller fuse devices. For example, the fuse device 500 can be configured such that when a first current threshold is reached, the movable contact 506 is forced away from the fixed contacts 502, 504. As this change is sudden, electrical arcing between the contacts can occur. In order to stagger this change or make this change more gradual, the secondary contact element 608 can be used and can allow some electrical flow to continue between the fixed contacts 502, 504 in absence of the movable contact 506 contacting the fixed contacts 502, 504. As the secondary contact has a high resistivity, the current through the fuse device is reduced. The secondary contact element 608 can then start to degrade to continue the complete interruption of the electrical flow through the fuse device 500, which will occur after the secondary contact element has degraded to the point where it no longer contacts the fixed contacts 502, 504. As the electricity can travel through the secondary contact element 608 for an interval of time before the secondary contact element 608 degrades, electrical arcing caused by the sudden interruption of the electrical flow through the device 500 is prevented or mitigated due to the additional electrical pathway provided by the secondary contact element.

While the embodiment of FIG. 10 discloses utilizing the secondary contact element 608 in addition to the movable contact 506, it is understood that in some embodiments, an element such as a wire-structure configured to degrade upon a certain current threshold being reached can be used in lieu of the movable contact. In these embodiments, the secondary contact element 608 actually functions as the primary structure to interrupt the flow of electricity through the fuse device.

Figure 11:
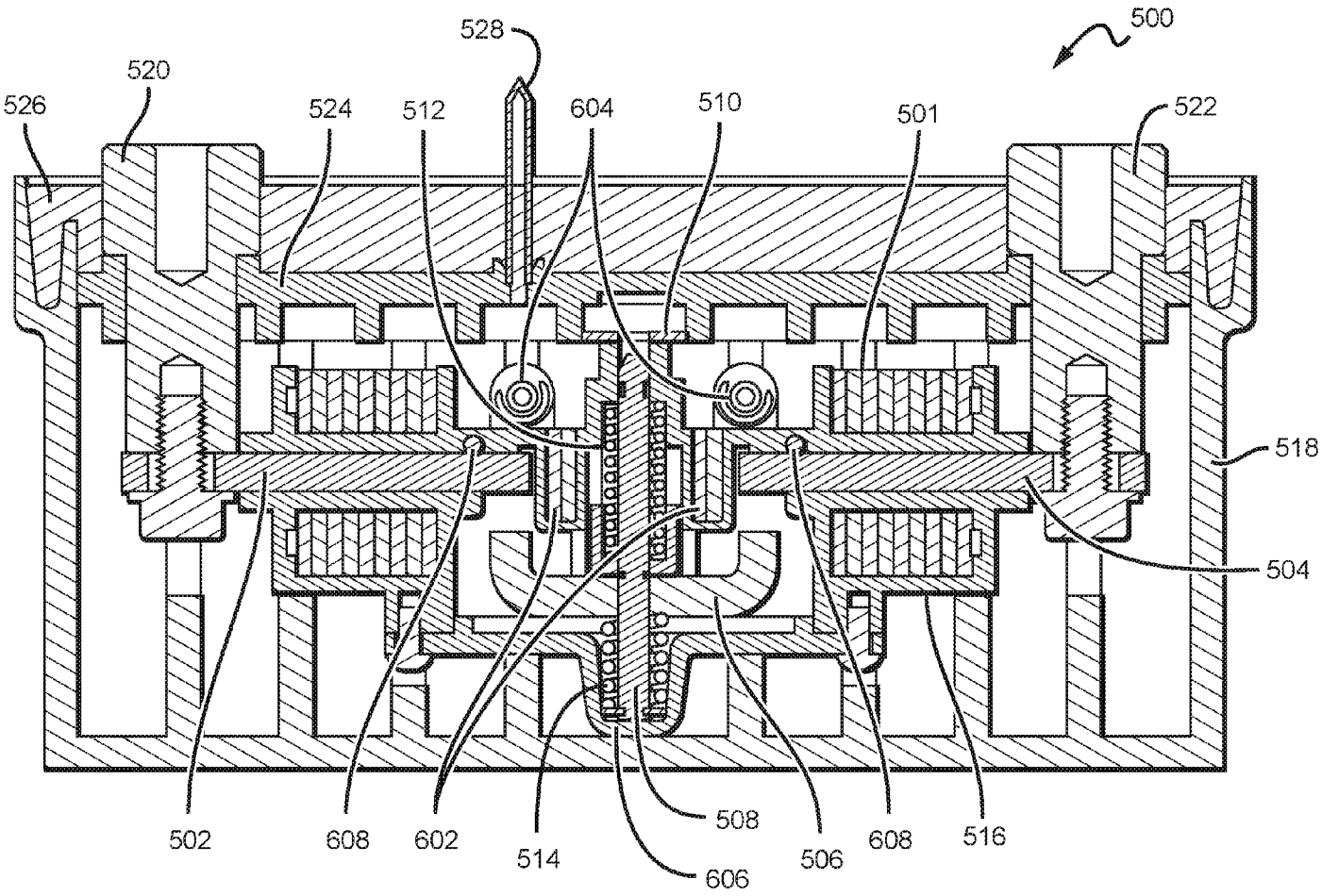
FIG. 11 is a top sectional view of the embodiment of the fuse device of FIG. 10, shown in a triggered position.

FIG. 10 shows the fuse device 500 in a set or non-triggered state, with the pin 508 held in place by the pin retention structure 510 and the movable contact 506 physically contacting the first and second fixed contacts 502, 504. This allows electricity to flow through the fuse device 500. The fuse device 500 in its triggered or interrupted state is shown in FIG. 11, which shows, the one or more first body portions 501, the one or more fixed contacts 502, 504, the one or more movable contacts 506, the pin 508, the one or more springs 512, 514, the compartment 516, the housing 518, the one or more housing contact structures 520, 522, the lid portion 524, sealing material 526, the tube 528, the one or more arc magnets 602, the one or more armature springs 604, the pin striking plate 606, and the one or more secondary contact elements 608. FIG. 11 shows the pin 508 unlatched from the pin retention structure and contacting the pin striking plate 606, which limits its movement as discussed above.

Figure 12:
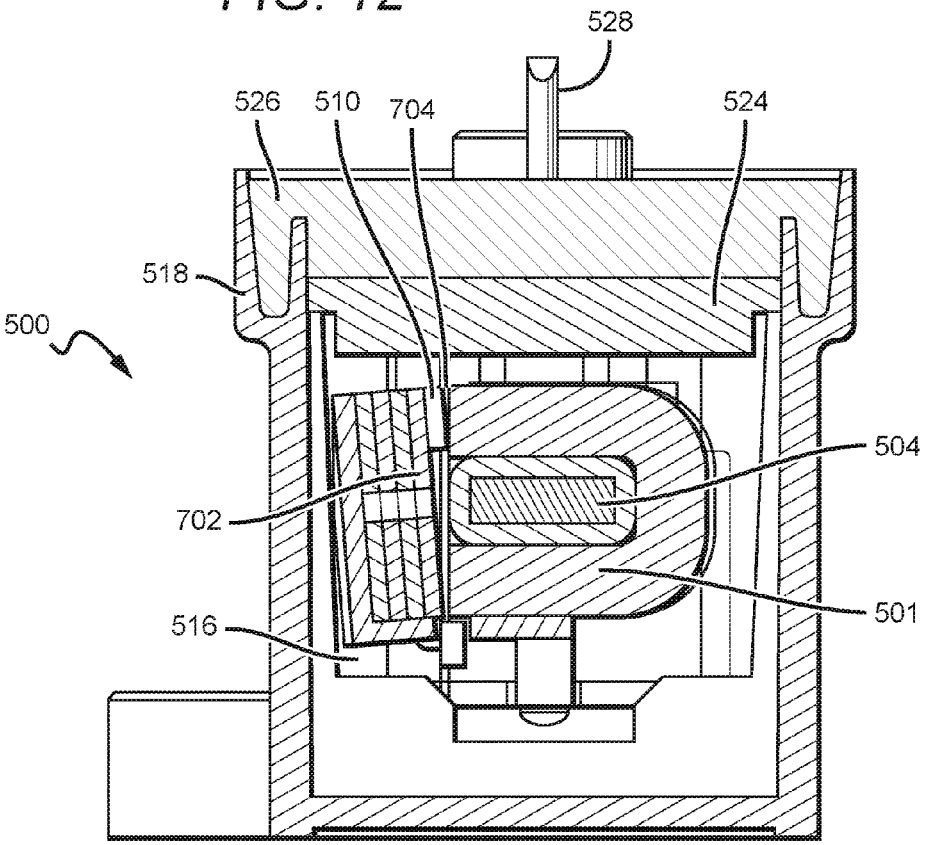
FIG. 12 is a right-side sectional view of the embodiment the fuse device of FIG. 10, shown in a non-triggered position.

The body configuration of the embodiment of FIG. 10, and how it differs from the embodiment of FIG. 1, can be clearly seen in FIG. 12, which shows the fuse device 500 in a non-triggered position, showing one of the first body portions 501, the second fixed contact 504, the pin retention structure 510, the compartment 516, the housing 518, the lid portion 524, sealing material 526, the tube 528, and one of the second body portions 702. FIG. 12 further shows a mechanical position gap 704 (similar to the mechanical position gap 150 in FIG. 2 above), located between the first body portion 501 and the second body portion 702.

In the embodiment shown in FIG. 12, the first body portion 501 and the second body portion 702 comprise magnetic circuits, for example, a conductive metal such as iron around a conductive element, although in some embodiments, these body portions 501, 702 can comprise other materials as set forth herein. As described in the embodiment of FIG. 1 above, when a threshold current flows through the device, a magnetic field is generated that is strong enough to overcome a mechanical force, for example, a force inherent to the body or a force generated by the armature springs, causing the first body portion 501 and the second body portion 702 to be drawn together, eliminating or shortening the mechanical position gap 704. This in turn causes the pin retention structure 510 to be displaced, which causes the pin and movable contact to move and interrupt the flow of electricity through the device. The fuse device 500 is shown in a non-triggered position in FIG. 12.

Figure 13:
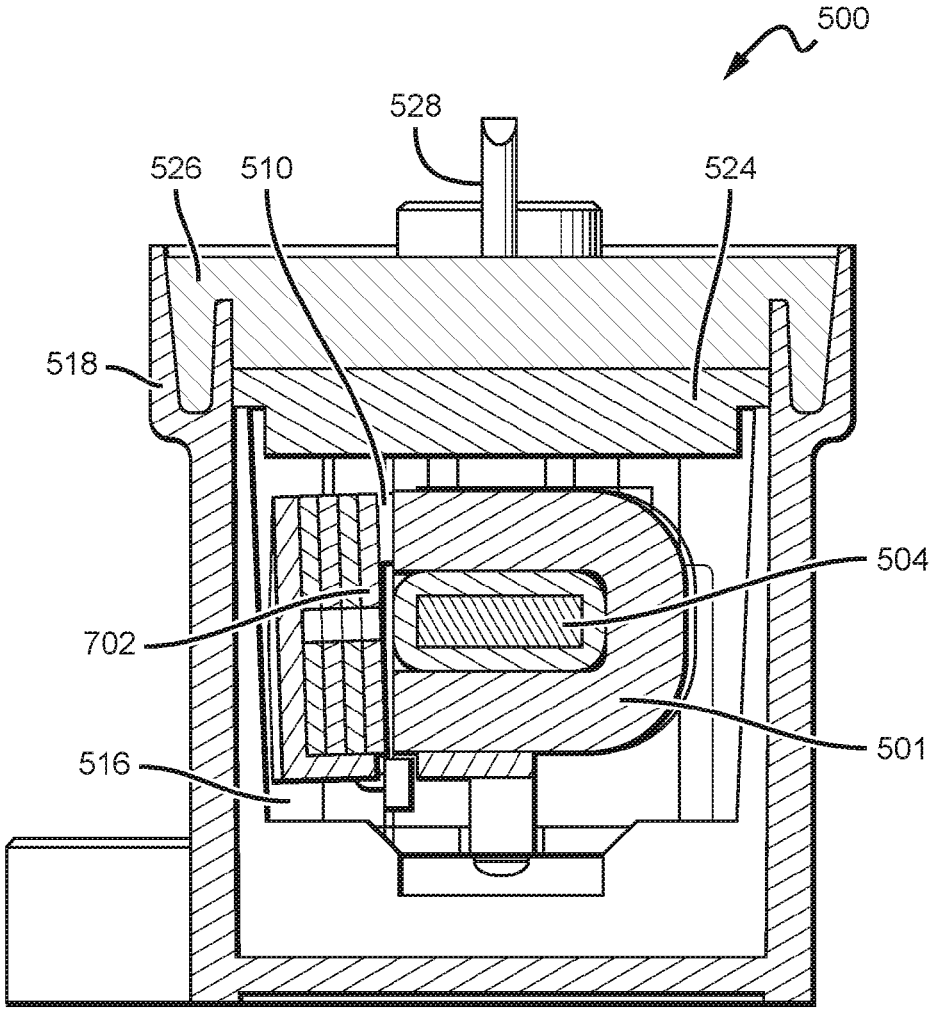
FIG. 13 is a right-side sectional view of the embodiment the fuse device of FIG. 10, shown in a triggered position.

The fuse device 500 is shown in a triggered position in FIG. 13, which shows one of the first body portions 501, the second fixed contact 504, the pin retention structure 510, the compartment 516, the housing 518, the lid portion 524, sealing material 526, the tube 528, and one of the second body portions 702. As shown in FIG. 13, when the device 500 is triggered, the mechanical position gap is eliminated, which changes the configuration of the pin retention structure 510.

Figure 14:
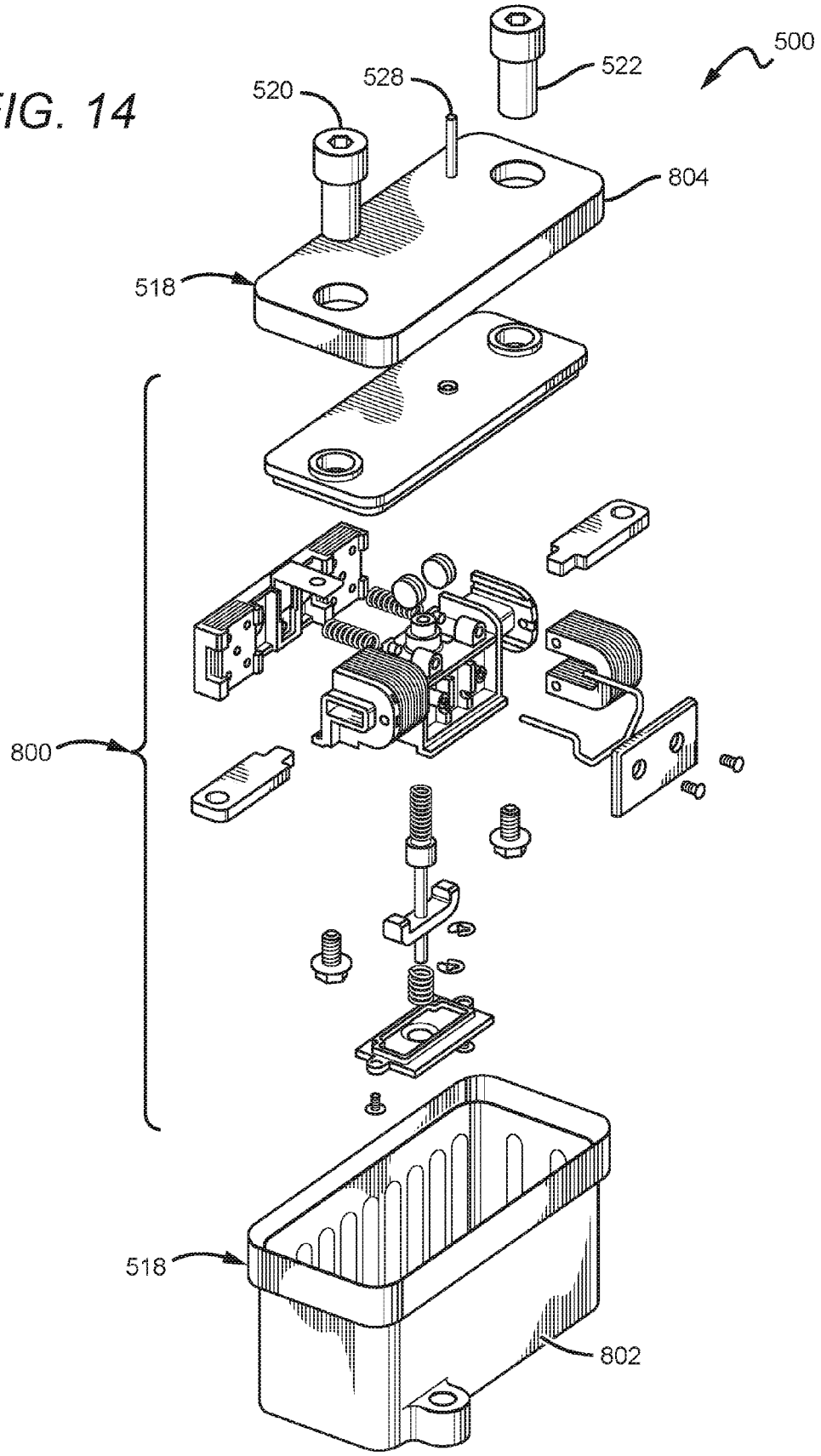
FIG. 14 is an exploded view of the embodiment of the fuse device of FIG. 10.

An overview of the position of the functional elements 800 of the fuse device 500 is shown in FIG. 14 in an exploded view, which shows the fuse device 500 comprising the housing 518, which comprises a lower housing portion 802 and an upper housing portion 804, the first and second housing contact structures 520, 522, and the tube 528. As can be seen in FIG. 14 the functional elements, which include features such as portions of the body and the various contact elements, can be contained in a housing structure, which can be hermetically sealed as set forth above.

The functional elements 800 described above are shown in more detail in FIG. 15, which shows, the one or more first body portions 501 (two shown), the one or more fixed contacts 502, 504, the one or more movable contacts 506, the pin 508, the pin retention structure 510, the one or more springs 512, 514, the compartment 516 (which comprises an inner housing 900, a secondary contact element chamber cover 902, the lid portion 524, a housing mount 904 and an endcap 906), the one or more arc magnets 602, the one or more armature springs 604, the one or more secondary contact elements 608 and the one or more second body portions 702 two shown).

Figure 15:
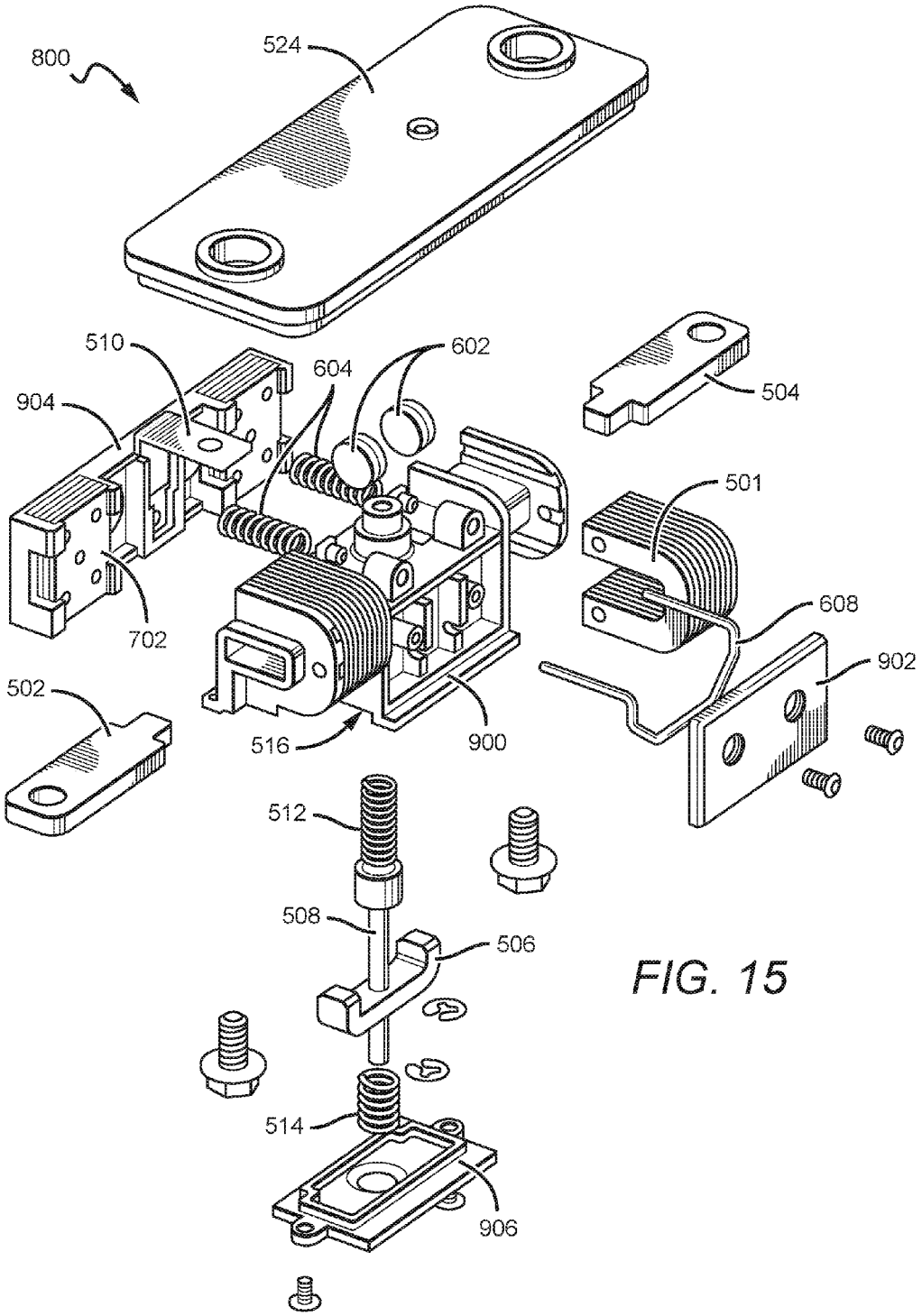
FIG. 15 is a partial exploded view of the embodiment of the fuse device of FIG. 10.

As the the first body portion 501 and the second body portion 702 are present in select areas of the device, rather than a body portion surrounding the majority of the device as with the embodiment of FIG. 1, large portions of the device can be manufactured with lightweight and economical materials such as various plastics, resins and non-metals. Also in contrast to the embodiment of FIG. 1, wherein the body 102 substantially surrounds the compartment 108, the embodiment of FIGS. 10-15 comprises a compartment 516 that substantially surrounds the first body portion 501 and the second body portion 702. As shown in FIG. 15, the first body portions 501 are configured to at least partially surround the fixed contacts 502, 504, and the second body portions 702 can be mounted to a portion of the compartment 516.

The secondary contact element 608 can be positioned in any suitable configuration that allows contact with the fixed contacts 502, 504. In some embodiments, the secondary contact element can be mostly contained in a separate portion of the compartment 516, for example, a portion of the inner housing 900 that is partially separated from the other internal components, such as the movable and fixed contacts. This separate portion of the compartment 516 can be at least partially enclosed within the inner housing 900 by the secondary contact element chamber cover 902. Portions of the secondary contact element 608 can be configured to pass into other areas of the inner housing 900 and to make contact with the fixed contacts as described herein.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in any claims.

We claim:

1. A fuse device, comprising:

a body comprising at least one body portion and comprising a mechanical position gap configured to at least partially separate a first body portion from a second body portion;

internal components within said fuse device, said internal components configured to change the state of said fuse device between a set state allowing current flow through the device and a triggered state which interrupts current flow through the device, wherein at least some of said internal components are at least partially surrounded by said at least one body portion;

contact structures electrically connected to said internal components for connection to external circuitry;

wherein said fuse device is configured such that when a threshold current level passes through said internal components, said body changes configuration in response to a generated electromagnetic field such that said first body portion is drawn toward said second body portion by said electromagnetic field, which causes said internal components to transition said fuse device to said triggered state.

2. The fuse device of claim 1, wherein said internal components comprise fixed contacts electrically isolated from one another.

3. The fuse device of claim 2, wherein said internal components further comprise one or more moveable contacts, said one or more moveable contacts allowing current flow between said fixed contacts when said one or more moveable contacts are contacting said fixed contacts.

4. The fuse device of claim 3, wherein said internal components further comprise one or more secondary contact elements electrically contacting said fixed contacts and allowing current flow between said fixed contacts when said one or more secondary contact elements are contacting said fixed contacts, said one or more secondary contact elements configured to degrade and no longer contact said fixed contacts when said one or more moveable contacts are not contacting said fixed contacts and current is flowing through said one or more secondary contact elements.

5. The fuse device of claim 4, wherein said one or more secondary contact elements comprise a wire structure.

6. The fuse device of claim 4, wherein said one or more secondary contact elements comprise nichrome.

7. The fuse device of claim 2, wherein said internal components further comprise one or more secondary contact elements electrically contacting said fixed contacts and allowing current flow between said fixed contacts when said one or more secondary contact elements are contacting said fixed contacts, said one or more secondary contact elements configured to degrade and no longer contact said fixed contacts after said threshold current level passes through said internal components.

8. The fuse device of claim 1, wherein said internal components are housed in a hermetically sealed environment.

9. The fuse device of claim 1, further comprising a mechanical resistance structure, said mechanical resistance structure configured to maintain said mechanical position gap until said threshold current level passes through said internal components.

10. A fuse device, comprising:

a body comprising at least one body portion;

internal components, said internal components comprising:

fixed contacts electrically isolated from one another, said fixed contacts at least partially surrounded by said at least one body portion;

one or more moveable contacts, said one or more moveable contacts allowing current flow between said fixed contacts when said one or more moveable contacts are contacting said fixed contacts;

an internal pin component connected to said one or more moveable contacts, said internal pin component biased toward a position that moves said one or more moveable contacts out of contact with said fixed contacts; and a pin retention structure configured to hold said internal pin component in place such that said one or more moveable contacts are contacting said fixed contacts; and contact structures electrically connected to said internal components for connection to external circuitry;

wherein said fuse device is configured such that when a threshold current level passes through said internal components, said pin retention structure changes configuration in response to a generated electromagnetic field, which releases said internal pin component from a held position to move according to its bias.

11. The fuse device of claim 10, wherein said internal components further comprise one or more secondary contact elements electrically contacting said fixed contacts and allowing current flow between said fixed contacts when said one or more secondary contact elements are contacting said fixed contacts, said one or more secondary contact elements configured to degrade and no longer contact said fixed contacts when said one or more moveable contacts are not contacting said fixed contacts and current is flowing through said one or more secondary contact elements.

12. The fuse device of claim 11, wherein said one or more secondary contact elements comprise a wire structure.

13. The fuse device of claim 12, wherein said one or more secondary contact elements comprise a high-resistance conductor.

14. The fuse device of claim 10, wherein said internal pin component is biased by a spring mechanism.

15. The fuse device of claim 10, wherein said body further comprises a mechanical position gap configured to at least partially separate a first body portion from a second body portion.

16. The fuse device of claim 10, wherein said internal components are housed in a hermetically sealed environment.

17. A fuse device, comprising:

a body comprising at least one body portion;

moveable and fixed contacts, said moveable and fixed contacts configured to change the state of said fuse device between a set state allowing current flow through the device and a triggered state which interrupts current flow through the device;

one or more secondary contact elements electrically contacting said fixed contacts, said one or more secondary contact elements providing an electrical pathway between said fixed contact structures;

contact structures electrically connected to said fixed contacts for connection to external circuitry;

wherein said fuse device is configured such that when a threshold current level passes through said contact structures and said moveable and fixed contacts, said body changes configuration in response to a generated electromagnetic field, which causes said device to transition to said triggered state and wherein said one or more secondary contact elements are configured to degrade and no longer contact said fixed contacts when said moveable contact is not contacting said fixed contacts and current is flowing through said one or more secondary contact elements.

18. The fuse device of claim 17, wherein said one or more secondary contact elements comprise nichrome wire.

* * * * *